United States Patent [19]

Errington

[11] 4,140,483

[45] Feb. 20, 1979

[54] REFRACTORY INSULATION

[75] Inventor: Paul A. Errington, Sunderland, England

[73] Assignee: Morgan Refractories Limited, Cheshire, England

[21] Appl. No.: 855,082

[22] Filed: Nov. 28, 1977

Related U.S. Application Data

[63] Continuation-in-part of Ser. No. 683,809, May 6, 1976, Pat. No. 4,071,311.

[51] Int. Cl.[2] ..... F27D 13/06; F27D 3/02

[52] U.S. Cl. ..... 432/234; 138/149; 29/129

[58] Field of Search ..... 432/233, 234, 235, 248; 138/147–149; 29/129

[56] References Cited

U.S. PATENT DOCUMENTS

| | | | |
|---|---|---|---|
| 1,832,143 | 11/1931 | Sitton | 138/147 |
| 3,149,826 | 9/1964 | Brough et al. | 138/147 |
| 3,486,533 | 12/1969 | Doherty et al. | 138/147 |
| 3,781,167 | 12/1973 | Ahonen | 432/234 |
| 3,804,585 | 4/1974 | Twort | 432/234 |
| 3,914,100 | 10/1975 | Guskea | 432/233 |
| 3,946,763 | 3/1976 | Wilce | 138/147 |
| 4,015,636 | 4/1977 | Van Fossen | 432/234 |

FOREIGN PATENT DOCUMENTS

| | | | |
|---|---|---|---|
| 1442921 | 7/1976 | United Kingdom | 432/234 |

*Primary Examiner*—Henry C. Yuen

*Attorney, Agent, or Firm*—Larson, Taylor and Hinds

[57] ABSTRACT

A metal tubular supporting member in a furnace is sheathed by refractory tiles held in place, over an inner layer of refractory fibrous material, by metal coupling links which grip around the furnace member and have projections engaging holes in the tiles.

6 Claims, 7 Drawing Figures

Fig.1
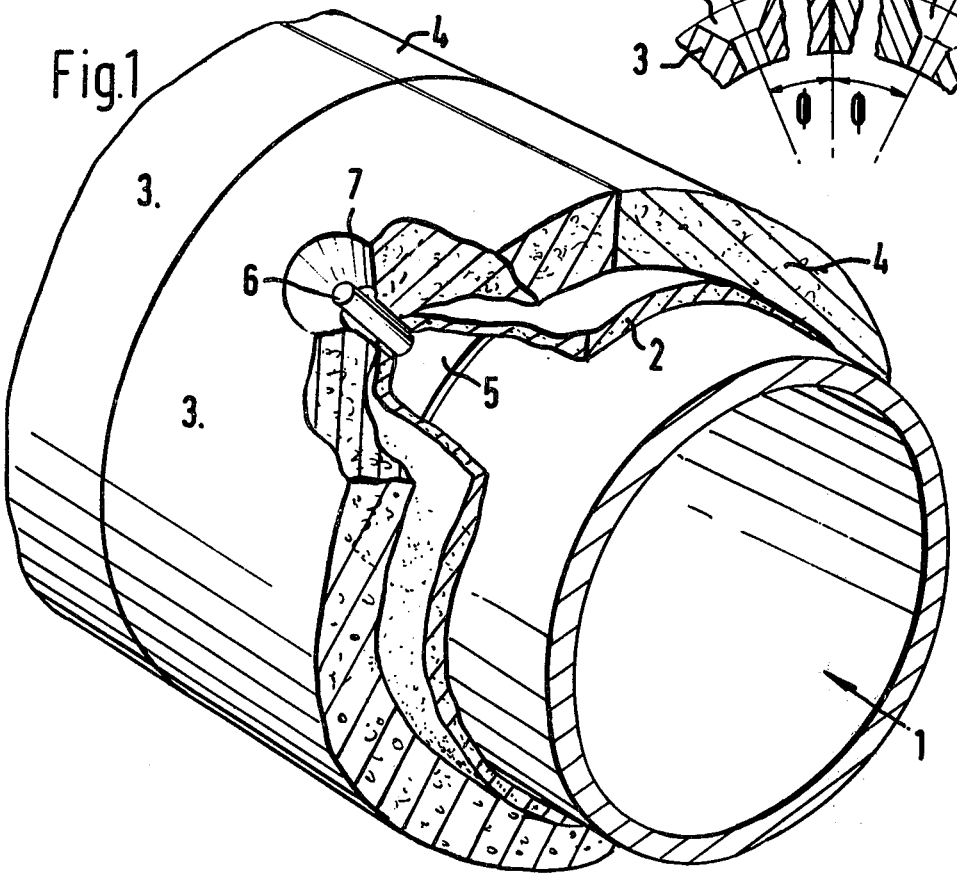
Fig.2
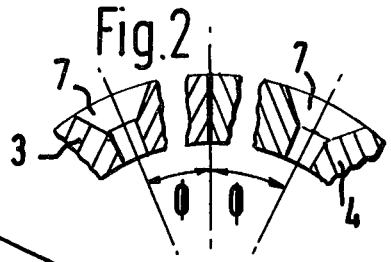
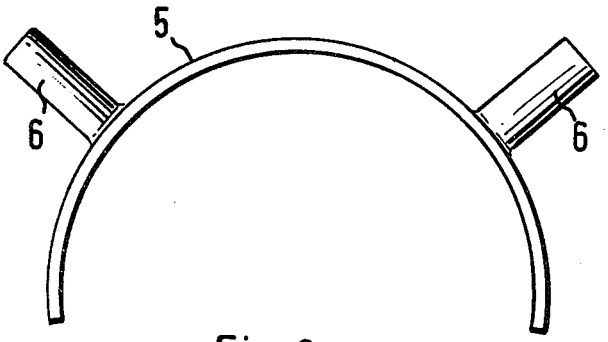
Fig.3
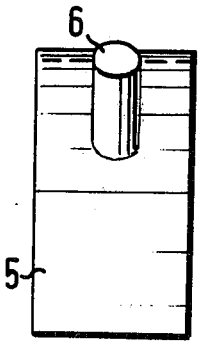
Fig.4

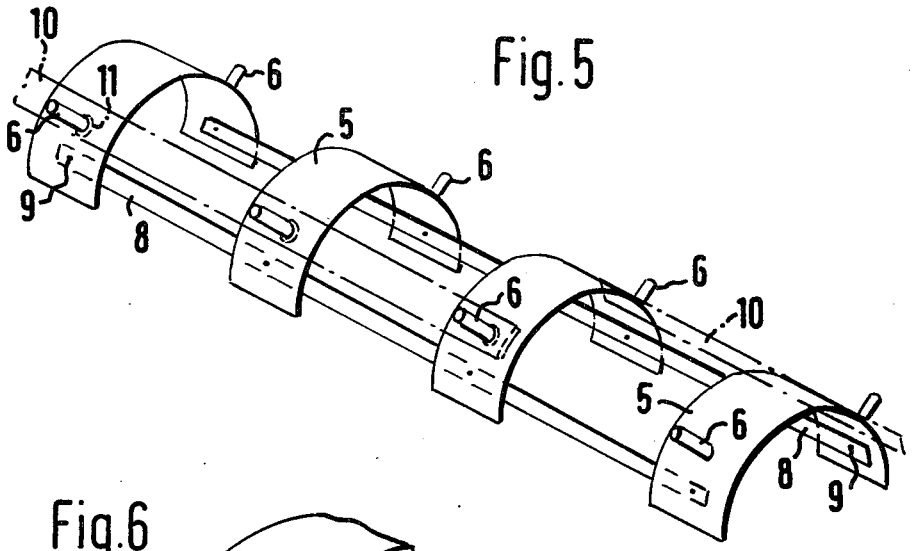
Fig. 5
Fig. 6
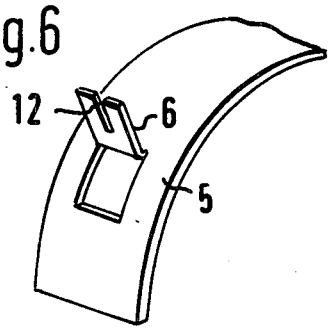
Fig. 7
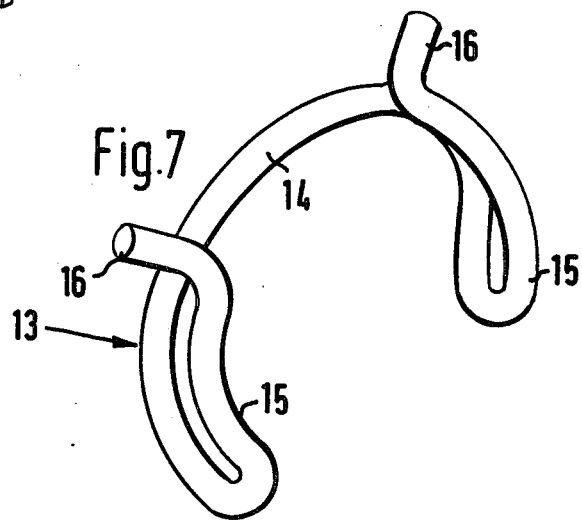

REFRACTORY INSULATION

This application is a continuation in part of my Application Ser. No. 683809 filed May 6, 1976, now U.S. Pat. 4071311.

BACKGROUND OF THE INVENTION

This invention relates to refractory insulation sheathing for furnace members made of tubular metal, in particular horizontal pipes of water cooled supporting structures for stock under treatment in a furnace.

The invention is especially suitable for cross-over pipes which support the rails along which stock is moved in reheat furnaces for ferrous slabs, and will be described as applied thereto, but application of the invention to tubular supporting rails themselves and to other tubular members in furnaces where similar conditions exist is not precluded.

In a reheat furnace, slabs must be heated to a very high temperature, for example 1100° to 1400° C., as uniformly as possible and the slabs are therefore moved, by pushers or walking beams, along raised skid rails, usually water-cooled hollow rails rupported by a structure, like a gantry, of water-cooled hollow members while they are heated from above and below by intensely hot gas blast from burners.

The supporting structure is directly in the path of hot gas and, as well as being water cooled, the hollow rails an supports are sheathed with refractory material.

Prior Art

It has been proposed to provide water-cooled metal pipes in furnaces with sheathing which comprises an inner resilient layer of refractory fibrous material, an outer layer of refractory tiles and means for holding the tiles in place.

Prior proposals in general comprise two categories, viz. tile-anchorages welded to the pipes and relatively complex tiles, in shape and/or structure, intended to interengage and hold in place on the pipes.

In the invention of my Application No. 683,809, now U.S. Pat. No. 4,071,311, of which this present Application is a continuation-in-part, the tiles are held in place by metal coupling links which each rest on and fit around an upper part of a pipe, are covered by the inner layer and have radially outwardly extending tile-engaging projections which extend through the inner layer into holes in circumferentially adjacent tiles which substantially meet in abutment overlapping each link so that tiles and links, with the inner layer interposed, positively interengage so as to embrace and hold in place around the pipe.

Essential feature of present invention

The present invention comprises the important provision of saddle-shaped coupling links, to fit around the upper half of the furnace member, having an angular extent of more than 180° so that they grip with a spring action around the furnace member.

The invention facilitates secure and rapid installation of sheathing and retains the technical advantage that the tiles are positively held in place, by their embracing engagement with the links, and are also cushioned and damped, against the loosening effects of vibration, by the resilient inner layer of fibrous material. Consequently the sheath as a whole is easily assembled and securely held in place but is cushioned against the effects of vibration and shock.

Supplementary features

Preferably, for a tubular support such as a cross-over pipe, the tiles are segments of a circular cylinder or any other tubular or annular shape, of any suitable continuous or polygonal cross-sectional outline. The invention is for example suitable for a tubular member of substantially triangular cross-section.

Annular sets of two, three or more tiles, corresponding to the outline or sides of the cross-section of a required sheath, can be assembled, with one or more coupling links as required, as ring-sets around the inner layer of fibrous material, as many ring-sets being arranged in series along the rail or pipe as are required to cover its length. Tiles of adjacent ring-sets may be arranged in interfitting or staggered relationship.

The joints between adjacent tiles in a ring-set, or between adjacent sets, may be simply butt-joints or of shouldered or other overlapping form.

The tile holes in which the link projections engage are preferably countersunk on the outer side and plugged with ceramic fibre and mortar when the sheath is installed.

DESCRIPTION OF THE DRAWINGS AND PREFERRED EMBODIMENT.

The invention is illustrated by way of example on the accompanying drawings, in which:

FIG. 1 is a perspective view of a section of a cross-over pipe with a refractory sheath according to the invention.

FIG. 2 is a fragmentary section to illustrate the angular location and form of tile holes, FIGS. 3 and 4 are respectively an axial elevation and a side view of a preferred saddle link in accordance with the invention, FIG. 5 is a perspective view of a multiple link assembly, FIG. 6 shows in fragmentary perspective view an alternative form of saddle link projection, and FIG. 7 is a perspective view of an alternative form of saddle link made from metal rod.

As shown by FIG. 1, a water-cooled metal pipe 1 has a refractory insulating sheath made up by an inner layer 2 of refractory fibrous material and an outer layer consisting of pairs of semi-cylindrical refractory tiles 3 and 4.

To hold each pair of tiles in place, a saddle-shaped coupling link 5 of metal is placed, on installation of the sheath, to rest directly on the pipe 1 and is first covered by the inner fibrous layer 2 which is wrapped, like a blanket, around the pipe. A suitable fibrous material is a ceramic fibrous sheet of about 14 mm thickness and a density of 64 – 96 Kg per $m^3$.

The link 5 has a pair of projections 6, in the form of studs, which are set apart at an angle which is twice the angle $\phi$ between one end of each tile and a hole 7 therein (FIG. 2). Thus, a pair of tiles butted together over the pipe present their holes 7 to match the studs 6 and engage therewith.

For clarity of illustration in FIG. 1, the countersunk holes 7 are shown open but in practice they are filled by an inner fibre plug or lining faced with refractory mortar or plastic refractory material.

A preferred form of saddle link 5 is shown by FIGS. 3 and 4 and consists of a C-shaped bank of mild steel plate which has an angular extent of about 200° C., so that it can spring over and grip around more than the upper half of the circumference of a pipe, and a pair of projecting studs 6, welded to the mild steel bank, the studs being of stainless steel or other heat-resistant metal. A longitudinally spaced series of coupling links may be connected together to make a multiple link assembly, as shown by FIG. 5, so that a series of ring-sets of tiles engaged with the studs 6 may be held against axial displacement. The series of links may be permanently interconnected by longitudinal metal strips 8 spot-welded to the links at 9. Alternatively, as indicated in broken lines in FIG. 5, separate metal connecting strips 10, with spaced holed 11, may be placed over the studs 6 of adjacent links so as to interconnect a series of links or adjacent assemblies of multiple links.

Instead of the saddle link projections 6 being studs, they may be lugs stamped and bent from a metal band as shown by FIG. 6. As illustrated, the lugs may be split or bifurated as at 12 so that they can be spread to lock in the tile holes 7. Stud projections may be also be bifurcated for the same purpose.

A different embodiment of saddle link is shown by FIG. 7 and consists of a length of metal rod 13 curved to a C-shaped middle portion 14, to grip over the upper half of a pipe, with its end portions 15 bent and curved back to terminate as radially outward projections 16 equivalent in purpose to the studs 6 of the other coupling links described above. The metal rod 13 is preferably of heat-resistant metal, such as stainless steel, throughout.

Any of the coupling links may have two or more studs or other projections at each end, to engage with one or more tiles with multiple or single holes.

The simple, semi-cylindrical tiles shown in FIG. 1 are only for illustration, other shapes of tiles could be used.

The holes 7 in the tiles need not be countersunk and could be blind holes, or recesses, not opening through to the outer surface of the tiles.

On installation in a furnace, the coupling links may be held in place, prior to wrapping with fibre and attachment of the tiles, by setting them in cement on the pipe. An air-setting cement, preferably of high thermal conductivity, would be suitable. Such cementing of the coupling links in place facilitates their initial location.

I claim:

1. A furnace member comprising a generally horizontal metal pipe in a furnace and insulated by refractory sheathing comprising metal coupling links which each rest on and fit around an upper part of the pipe, said links being saddle-shaped with a angular extent of more than 180° and gripping with a spring action around the pipe, an inner resilient layer of refractory fibrous material covering said links, tile-engaging substantially radial projections from said links extending through said inner layer, and an outer layer of refractory tiles which extend around and cover the inner layer with circumferentially-adjacent tiles substantially meeting in abutment overlapping each coupling link and having holes engaged by said projections so that each link secures together two circumferentially-adjacent tiles and said tiles and links, with the inner layer interposed, positively interengage so as to embrace and hold in place around the pipe.

2. A furnace member according to claim 1, in which said coupling links are C - shaped metal bands with an angular extent of about 200°.

3. A furnace member according to claim 2, in which longitudinally spaced series of said coupling links are connected together to make a multiple link assembly and longitudinal series of ring-sets of said tiles engaged with said assembly are thereby held against axial displacement.

4. A furnace member according to claim 3, in which said series of coupling links are connected together by metal connecting strips secured thereto.

5. A furnace member according to claim 4, in which said metal connecting strips have spaced holes placed over respective tile-engaging projections of said series of coupling links.

6. A furnace member according to claim 1, in which said coupling links consist of metal rod curved to form a C - shaped middle portion, to grip over the pipe, with end portions bent and curved back to terminate as radially outward tile-engaging projections.

* * * * *